US007681882B2

(12) United States Patent
Yu et al.

(10) Patent No.: US 7,681,882 B2
(45) Date of Patent: Mar. 23, 2010

(54) DE-SKEW MECHANISM

(75) Inventors: Chang-Lung Yu, Hsinchu (TW); Chen-Tsai Tsai, Hsinchu (TW); Hsueh-Chou Hsu, Hsinchu County (TW); Tien-Ho Hsu, Hsinchu (TW)

(73) Assignees: Silitek Electronic (Guangzhou) Co., Ltd., Guangzhou (CN); Lite-On Technology Corp., Taipei (TW)

( * ) Notice: Subject to any disclaimer, the term of this patent is extended or adjusted under 35 U.S.C. 154(b) by 0 days.

(21) Appl. No.: 12/126,919

(22) Filed: May 25, 2008

(65) Prior Publication Data

US 2009/0102117 A1 Apr. 23, 2009

(30) Foreign Application Priority Data

Oct. 19, 2007 (CN) ..... 2007 1 0030983

(51) Int. Cl.
*B65H 9/04* (2006.01)

(52) U.S. Cl. ..... 271/243; 271/245; 271/246

(58) Field of Classification Search ..... 271/243, 271/245, 246
See application file for complete search history.

(56) References Cited

U.S. PATENT DOCUMENTS 4,473,222 A * 9/1984 Simmons et al. ..... 271/245
4,844,443 A * 7/1989 Trafton ..... 271/245
5,233,400 A * 8/1993 Cahill ..... 399/395
6,011,948 A 1/2000 Amano et al.
6,934,505 B2 * 8/2005 Shin ..... 399/395
2007/0126176 A1 * 6/2007 Ha ..... 271/245
2008/0143045 A1 * 6/2008 Yu et al. ..... 271/245

FOREIGN PATENT DOCUMENTS

JP 05338865 A * 12/1993

* cited by examiner

*Primary Examiner*—David H Bollinger
(74) *Attorney, Agent, or Firm*—Kile Goekjian Reed & McManus PLLC

(57) ABSTRACT

A de-skew mechanism, in an image forming device, with a correcting member disposed in a rotatable manner to the rotary shaft and turning with driving roller by a spring between them. A torque spring suppresses the turning of the correcting member to correct the skew of the medium. When conveyed, the medium will butt against the correcting member to be stopped and corrected. The medium conveying force and the force that the spring brings to the driving roller are sufficient for turning the correcting member and passing therethrough. At one time, the force that the correcting member brings to the medium will reduce to zero. As such, the medium will not be damaged by the correcting member while being conveyed.

11 Claims, 11 Drawing Sheets

DE-SKEW MECHANISM

BACKGROUND OF THE INVENTION

1. Field of the Invention

The present invention relates to a medium conveying mechanism in an image equipment such as a printer or a scanner, and more particularly, to a de-skew mechanism.

2. Description of the Prior Art

Sometimes images are printed or scanned to be oblique due to skew of the medium or tolerances of the roller assembly. To avoid the above condition, various methods are utilized to de-skew before the medium enters the printing or scanning area.

U.S. Pat. No. 6,011,948 discloses a correcting device in an image formation equipment. Please refer to FIG. 10, 11. The correcting device includes shutter members 15 and a connecting member 16. The shutter members 15 are integrally connected to one another via the connecting member 16. The correcting device is engaged in a rotating manner with the rotary shaft 18, to which the free conveyer rollers 13 are fixed. The twisted coil spring 24 is engaged in a sliding manner with a rotary shaft 18 with the end 24*b* thereof on the side of the connecting member 16. The shutter members 15 are provided with the collision surfaces 20*a*, which act as sheet leading edge collision surfaces. The sheet S forms a curved loop when pushing the shutter members 15, and after the shutter members 15 turn a certain angle, skew of the sheet S is corrected. After sheet S passes through the roller group, the shutter members 15 return to their initial positions by the twisted coil spring 24. The correcting device has a simple structure and lower cost, but it has some disadvantages. For example, when the sheet S passes through the roller group, the shutter members 15 will exert greater force onto the sheet S by the twisted coil spring 24, and this tends to damage sheet S. In addition, the skew generated by the tolerance of roller assembly cannot be corrected by the correcting device since the correcting device is disposed on the rotary shaft 18. Furthermore, when the leading edge of the sheet S contacts the shutter members 15, the correcting process for the skew is performed while conveying the sheet S, which has counterproductive effects on the correction effort.

SUMMARY OF THE INVENTION

It is therefore one of the objectives of the present invention to provide a de-skew mechanism, wherein when skew of the medium is corrected and leading edge of the medium reaches a nip portion of the roller group, the force that the correcting member brings to the medium will reduce to zero, and thus the medium will not be damaged by the correcting member while being conveyed.

According to an embodiment of the present invention, a de-skew mechanism is disclosed to solve the above problem. The de-skew mechanism includes: a rotary shaft, rotated by a motor; a driving roller, disposed on the rotary shaft and rotated with the rotary shaft; a pinch roller, rotating in an opposite direction to the driving roller to form a nip portion to convey a medium; a correcting member, disposed on the rotary shaft along a conveying direction of the medium, for rotating at a disposed position of the correcting member between a correcting position and a releasing position of the correcting member; a suppressing member, selectively contacting with the correcting member, for exerting a suppressing force on turning of the correcting member with the driving roller to allow the correcting member to be in the correcting position; and a driving member, disposed on the rotary shaft and connected to the correcting member and the driving roller, for turning the correcting member with the driving roller, and for letting the correcting member come off the suppressing member with the medium conveying force to unload the suppressing force to let the correcting member move to the releasing position from the correcting position.

The correcting member has a bearing portion, and the bearing portion and the suppressing member selectively connect to each other to load the suppressing force. The correcting member further has a correcting portion for correcting a skew of the medium, and the bearing portion and the correcting portion are positioned on two sides of the correcting member, respectively. The correcting portion is a protruding object. The bearing portion is a protruding object or a recess fillister.

The suppressing member has a suppressing end, and the suppressing end and the suppressing member selectively connect to each other to load the suppressing force. The suppressing member further has a fixed end connected to an adjusting structure. The adjusting structure includes at least two adjacent protruding pillars. The suppressing portion is an elastic object, and the elastic object can be a torque spring or an elastic sheet. The driving member is a spring. A contacting surface between the correcting portion and the medium for correcting skew of the medium better and align the medium.

Since an elastic device is disposed between the driving roller and the correcting member in the de-skew mechanism, when the leading edge of the medium reaches the nip portion of the roller group, the elastic device comes off the bearing portion, and the correcting member turns with the driving roller by the elastic device between them. The force that the correcting member brings to the medium reduces to zero, and thus the medium is not damaged by the correcting member while being conveyed. The elastic device disposed on the frame matches with the bearing portion on the correcting member, and the correcting member is static during the process of correcting the skew of the medium to realize a better de-skew effect. At least two protruding objects are disposed on the frame, and skews of mediums having different thicknesses can be corrected via pushing the torque spring on the different protruding objects.

These and other objectives of the present invention will no doubt become obvious to those of ordinary skill in the art after reading the following detailed description of the preferred embodiment that is illustrated in the various figures and drawings.

DETAILED DESCRIPTION

The present invention is further illustrated with figures in the following.

Figure 1:
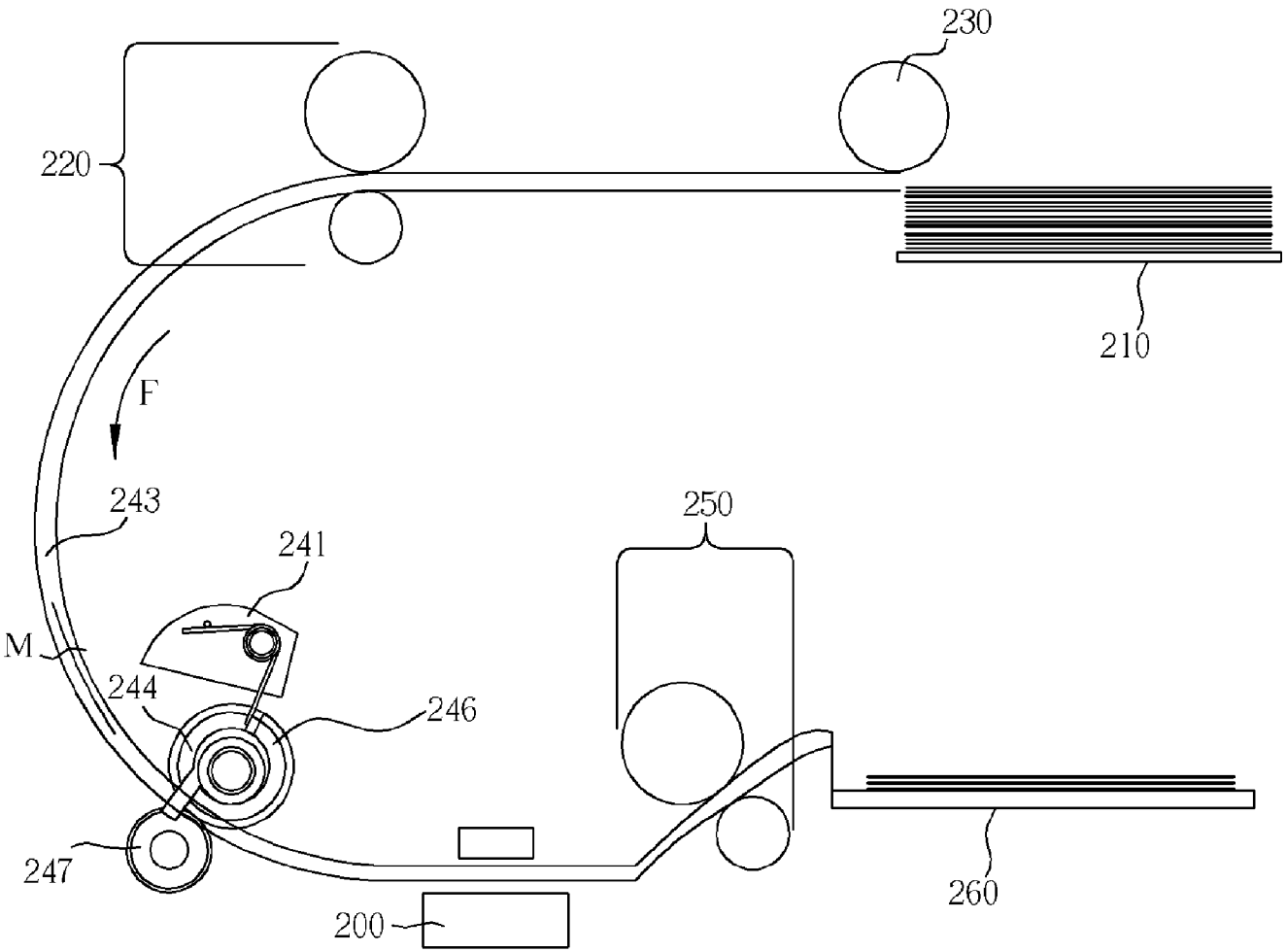
FIG. 1 is a schematic diagram of a scanner paper-feeding mechanism adopting a de-skew mechanism according to a first embodiment of the present invention.

FIG. 1 is a schematic diagram of a scanner paper-feeding mechanism adopting a de-skew mechanism according to a first embodiment of the present invention, which includes medium M stacked in a paper-feeding plate 210. A paper-taking roller 230 is disposed on a start end of a medium-feeding path. The paper-taking roller 230 takes the medium M out from the paper-feeding plate 210 one by one, and feeds the medium M into a medium-conveying path 243. A feeding roller 220 feeds the medium M in a direction F along the medium-conveying path 243. After passing through a driving roller 246 and a pinch roller 247, the medium M is scanned by a scanning module. The scanned medium is conveyed to a paper-exiting plate 260 by a paper-exiting roller 250. The driving roller 246, the pinch roller 247, and a correcting member 251 connected to the driving roller 246 are disposed on the medium-conveying path 243.

Figure 2:
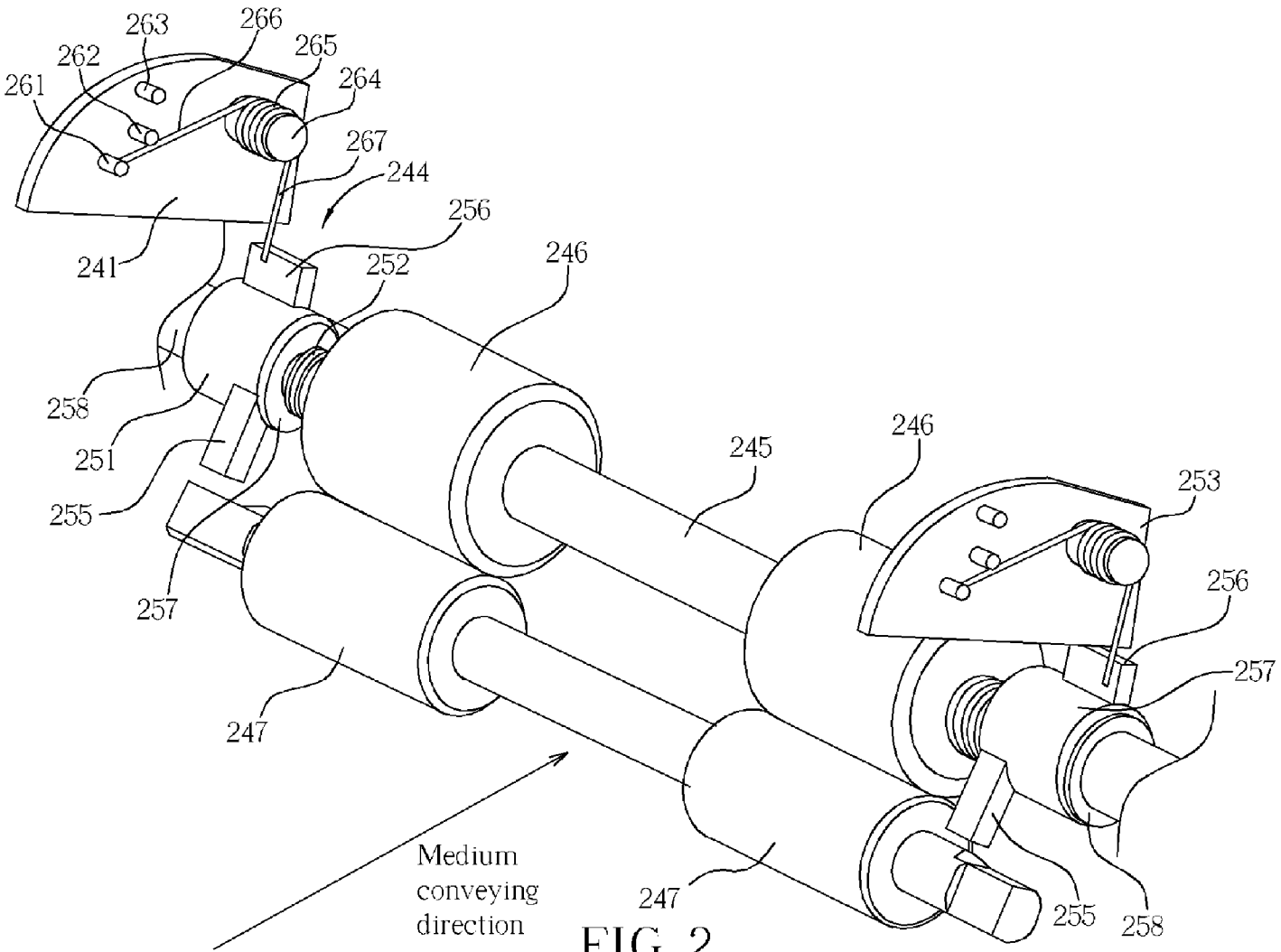
FIG. 2 is a schematic diagram of the de-skew mechanism according to the first embodiment of the present invention.

Please refer to FIG. 2. A rotary shaft 245 is disposed on a scanner frame, and the driving roller 246 is fixedly disposed on the rotary shaft 245 and rotated by a motor (not shown). The pinch roller 247 is disposed below the driving roller 246 and rotates oppositely to the driving roller 246 to form a nip portion to nip and convey the medium. The correcting member 251 is installed on the rotary shaft 245 and turns according to the rotary shaft 245. The correcting member 251 is disposed on a side of the driving roller 246 and close to a frame 241. A spring 252 is installed on the rotary shaft 245 and between the correcting member 251 and the driving roller 246. Two sides of the spring 252 are tightly connected to a connecting surface 257 of the correcting member 251 and a surface of the driving roller 246, respectively. In this way, when the driving roller 246 rotates along the paper-conveying direction, the correcting member 251 rotates with the driving roller 246 by the spring 252, due to the connection between them.

Figure 3:
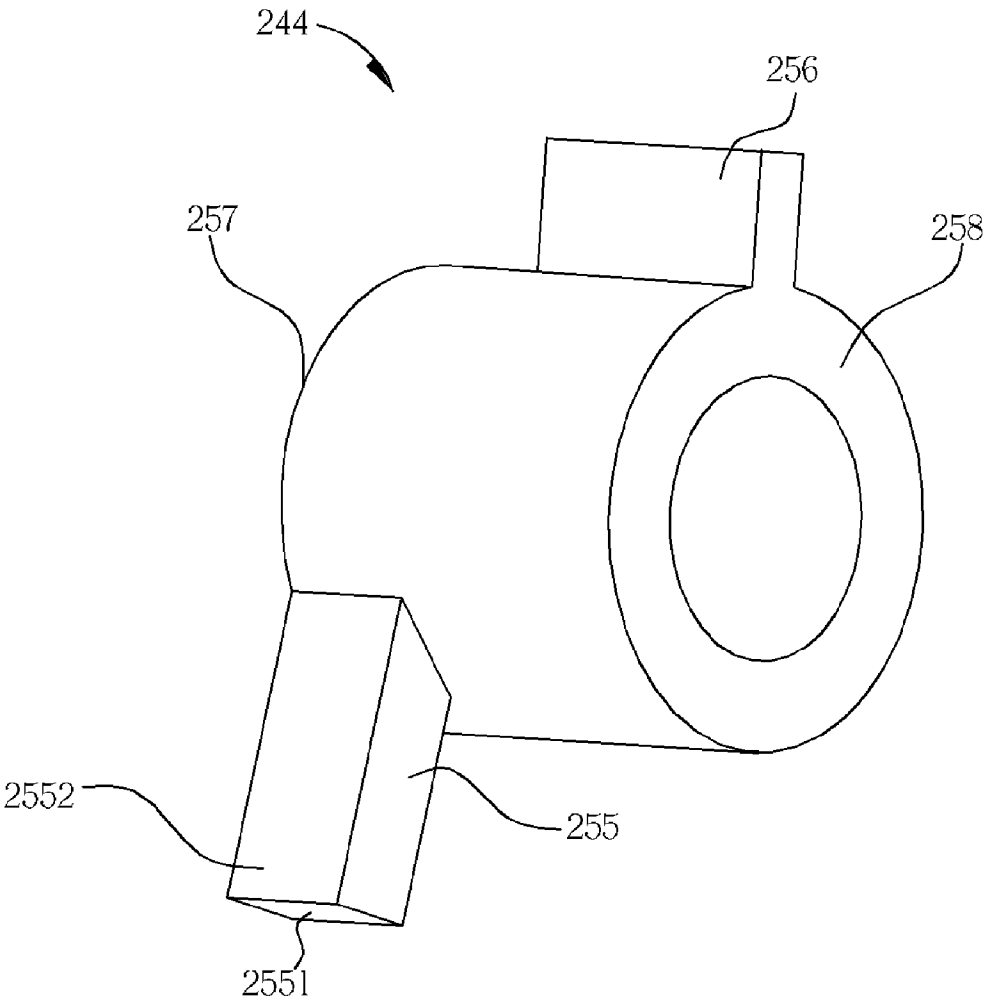
FIG. 3 is a schematic diagram of the correcting member shown in FIG. 2.

The correcting member 251 disposed on the rotary shaft 245 has a correcting position and a releasing position. The correcting position can be perpendicular to a leading edge of the medium M from the paper-conveying direction, since the correcting portion 255 protruding on the surface of the correcting member 251 adjacent to the connecting surface is vertical. The bearing portion 256 protruding on the correcting member 251 can contact with a suppressing end 267 of suppressing torque spring 253 to suppress the correcting member 251 to prevent the correcting member 251 from turning with the driving roller 246. Please refer to FIG. 3. The correcting portion 255 is disposed near the connecting surface of the correcting member 251, and the bearing portion 256 is disposed near the free surface of the correcting member 251.

Meanwhile, the torque spring 253 is disposed above the correcting member 251, and fixedly engaged with a protruding pillar 264 of the frame 241. There are three protruding pillars 261, 262, 263 disposed on the frame 241 as an adjusting structure. The torque spring 253 has two functional ends including a fixing end 266 leaning against one of the protruding pillars 261, 262, 263 according to the medium thickness. In this embodiment, the fixing end 266 leans against the protruding pillar 262. The suppressing end 267 of the torque spring 253 contacts the bearing portion 256 on the correcting member 251 and leans against the bearing portion 256 properly to prevent the correcting member 251 from continuously turning with the driving roller 246. In this way, the correcting portion 255 can stop the medium M from skewing.

Figure 4:
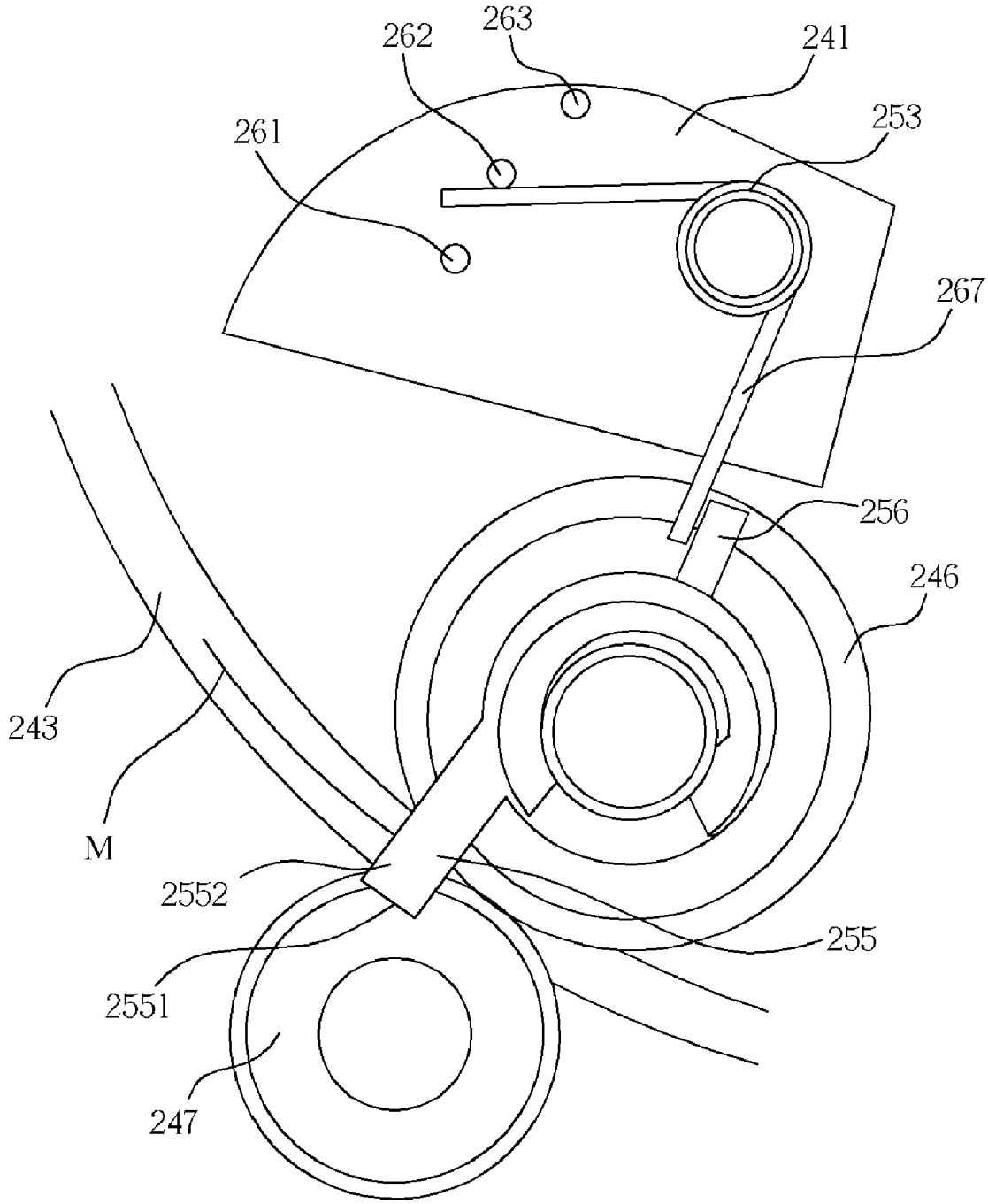
FIG. 4-7 are cross-sectional diagrams of the de-skew mechanism shown in FIG. 2.
Figure 5:
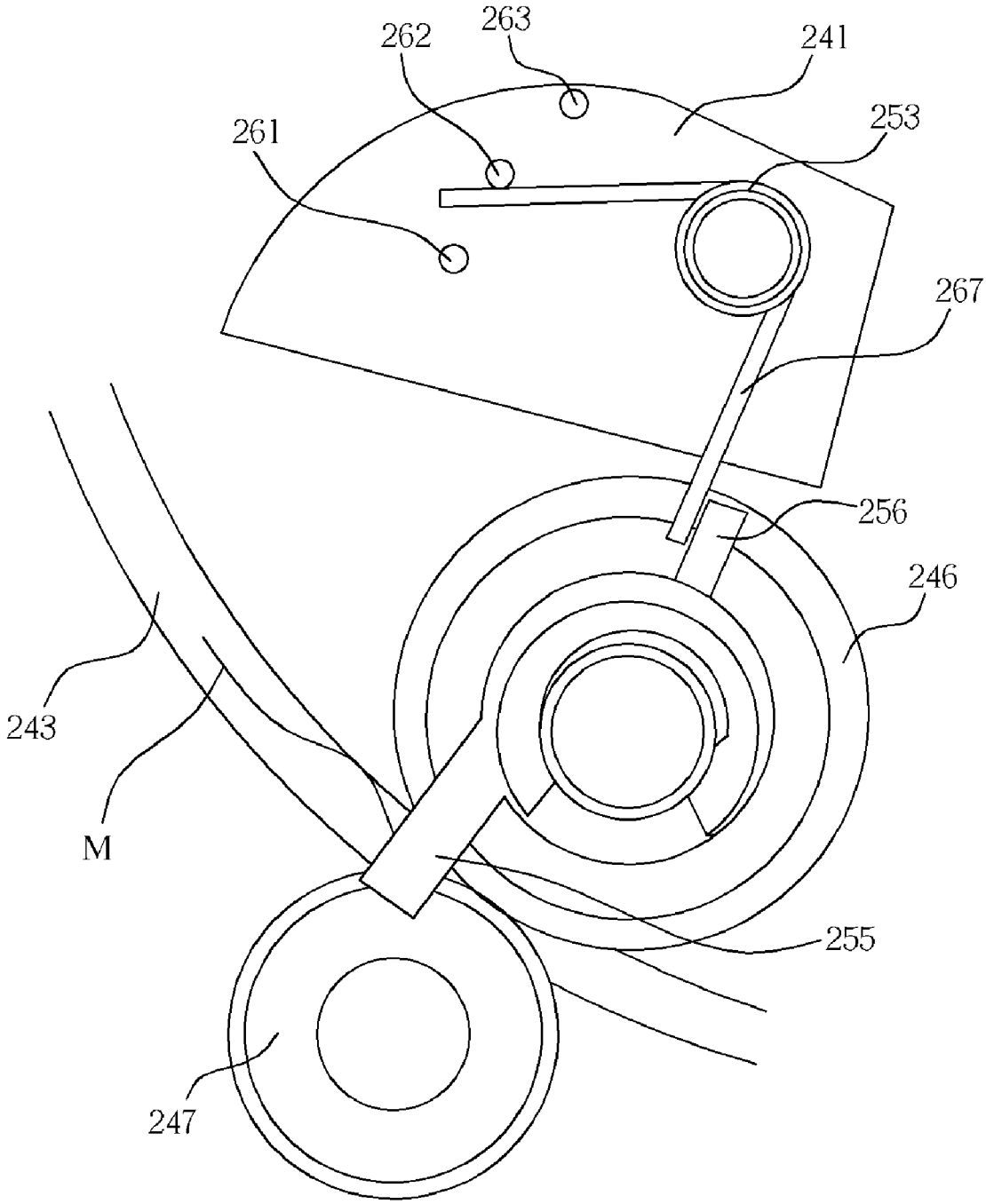
Figure 6:
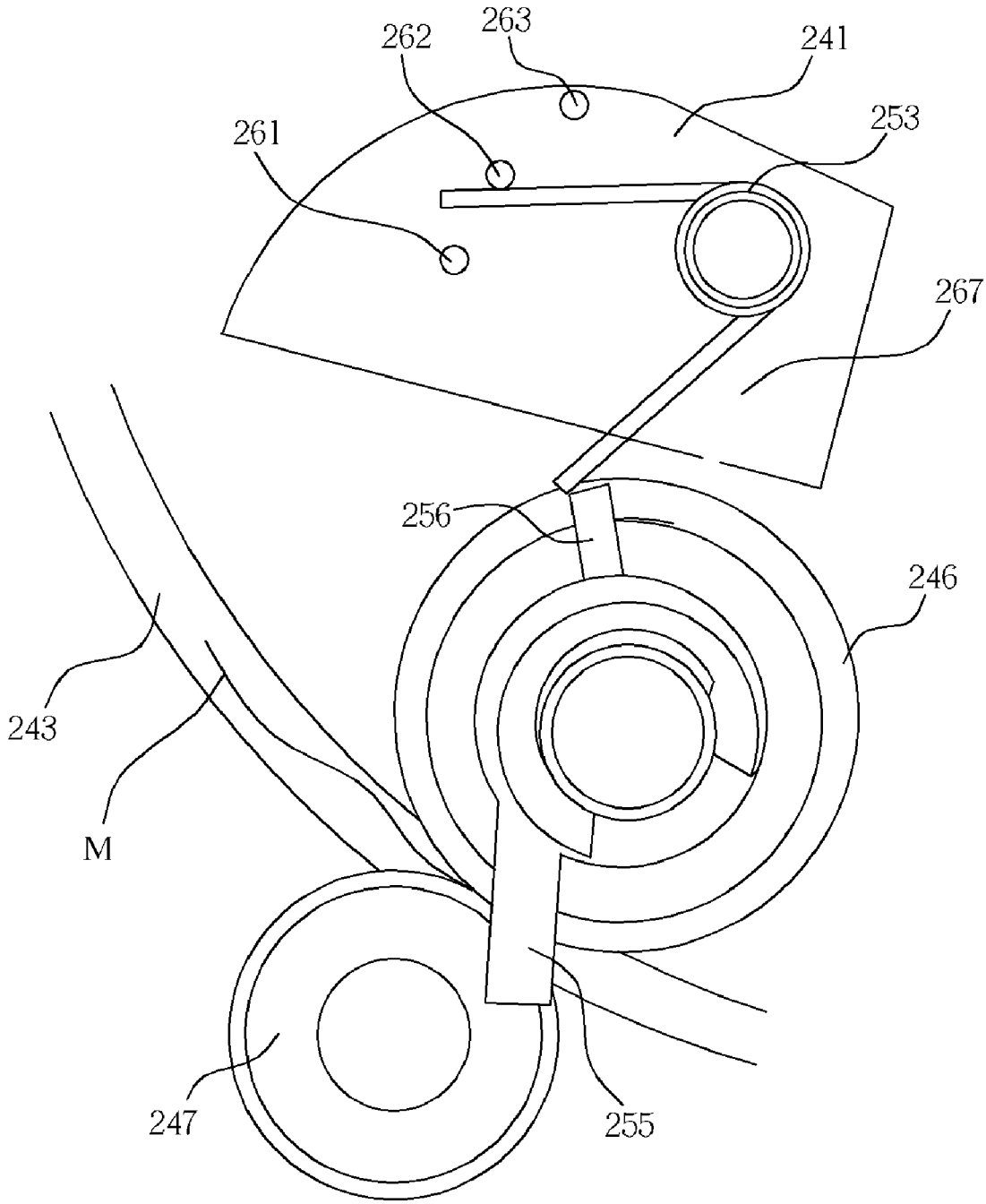
Figure 7:
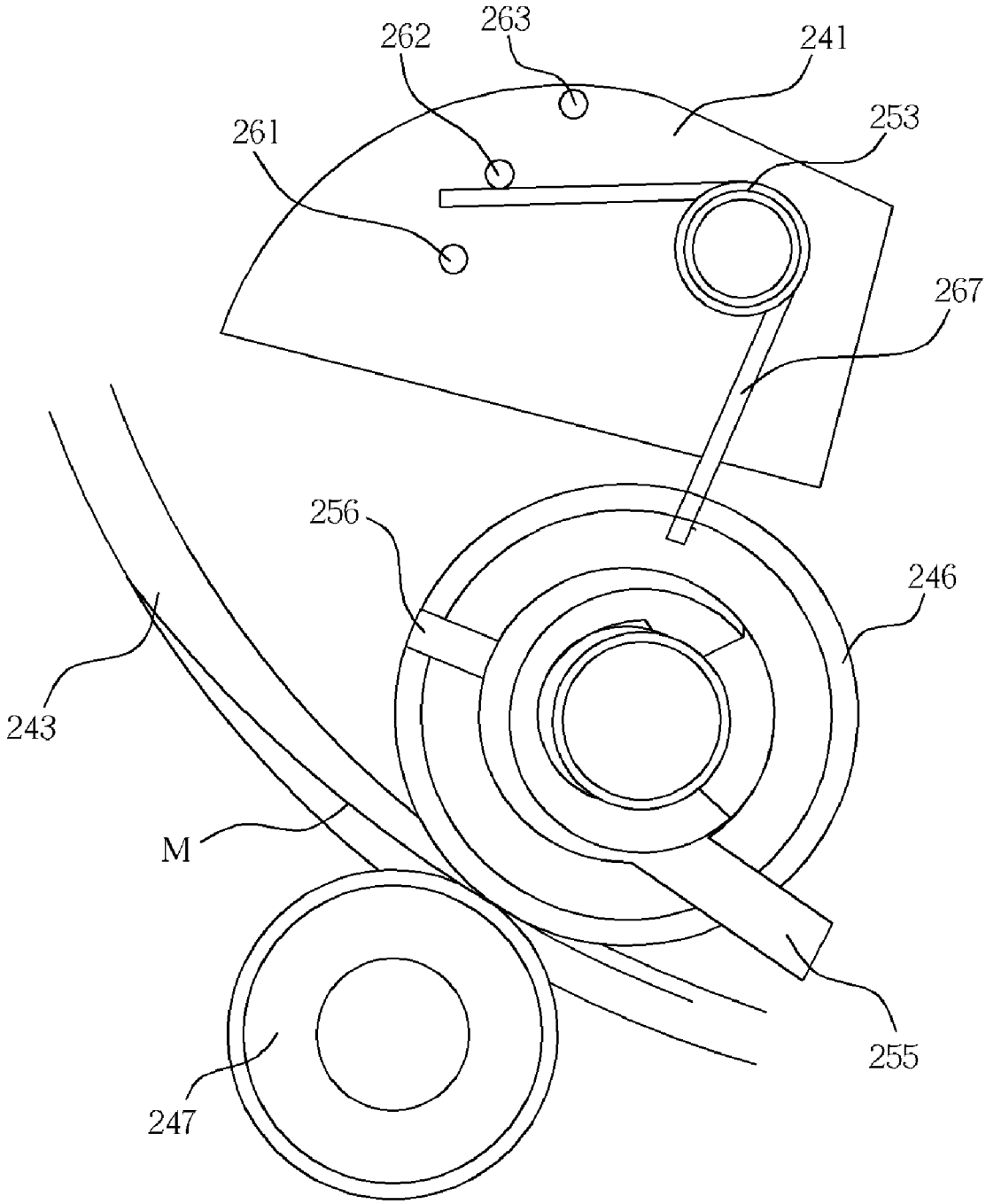

Please refer to FIG. 4. The driving roller 246 makes the correcting member 25 start to turn via the spring 252 in the paper-feeding process. When the suppressing end 267 of the torque spring 253 on the frame 241 leans against the bearing portion 256 on the correcting member 251, the correcting member 251 stops turning. A free end 2551 of the correcting portion 255 is in the medium-conveying path 243. When the conveyed medium M is skewed, a corner of the leading edge of the conveyed medium M contacts a flat surface 2552 of the correcting portion 255 first. When a common force of the conveyed medium M and the turning driving roller 246 to the correcting member 251 are not enough for the correcting member 251 to overcome the elastic force of the torque spring 253 to stop turning, the medium M will gradually form a curved portion since the medium M still moves by the force of the feeding roller 220. Please refer to FIG. 5. After the leading edge of the medium M stays completely in contact to the flat surface 2552 of the correcting portion 255, the skew of the medium M is corrected. Next, the pushing force of the medium M to the correcting portion 255 will gradually increase, and force of the driving roller 246 to the correcting member 251 will increase when the torque spring 253 is gradually deformed. When the common force of the medium M and the turning driving roller 246 to the correcting member 251 increases to be larger than the elastic force of the torque spring 253 to the correcting member 251, the correcting member 251 will start to turn, and the leading edge of the medium M still stays close to the correcting portion 255 under the force of the feeding roller 220. Please refer to FIG. 6. When the correcting member 251 turns to a certain angle and the leading edge of the medium M reaches to the nip portion of the driving roller 246 and the pinch roller 247, the suppressing end 267 of the torque spring 253 on the frame 241 will come off from the bearing portion 256 on the correcting member 251, and the correcting member 251 keeps turning with the driving roller 246 under the force of the torque spring 253. Please refer to FIG. 7. The force that the bearing portion 256 on the correcting member 251 brings to the leading edge of the medium M will reduce to zero. The correcting member 251 moves to the releasing position from the correcting position. The driving roller 246 and the pinch roller 247 convey the de-skewed medium M to the scanning unit 200 and prevent the correcting member 251 from damaging the medium M. When the correcting member 251 turns and the bearing portion 256 thereon is leaned on by the suppressing end 267 of the torque spring 253 again, a correcting process for skew of the next medium M will be started.

Figure 8:
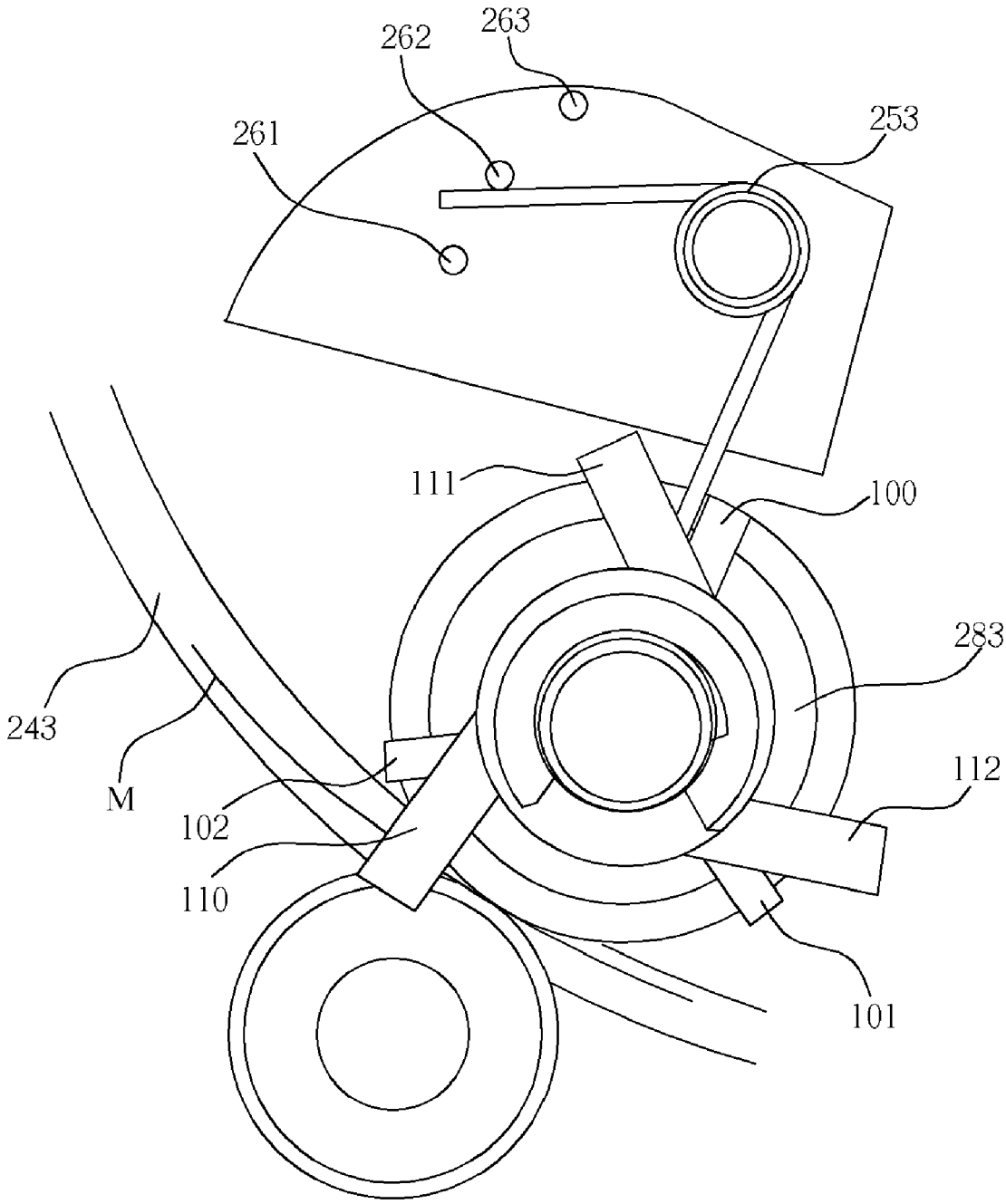
FIG. 8 is a cross-sectional diagram of a de-skew mechanism according to a second embodiment of the present invention.
Figure 9:
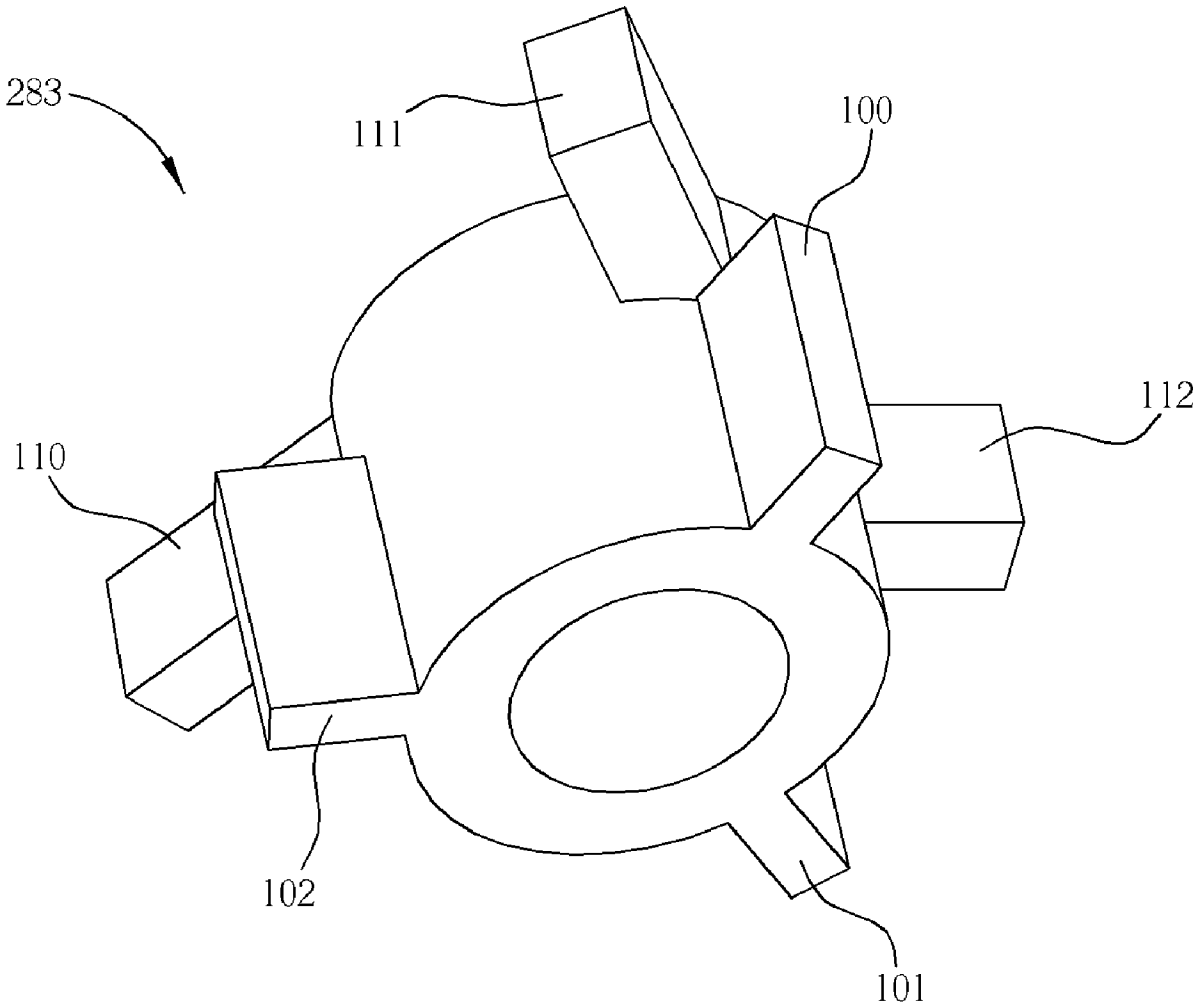
FIG. 9 is a schematic diagram of the correcting member shown in FIG. 8.
Figure 10:
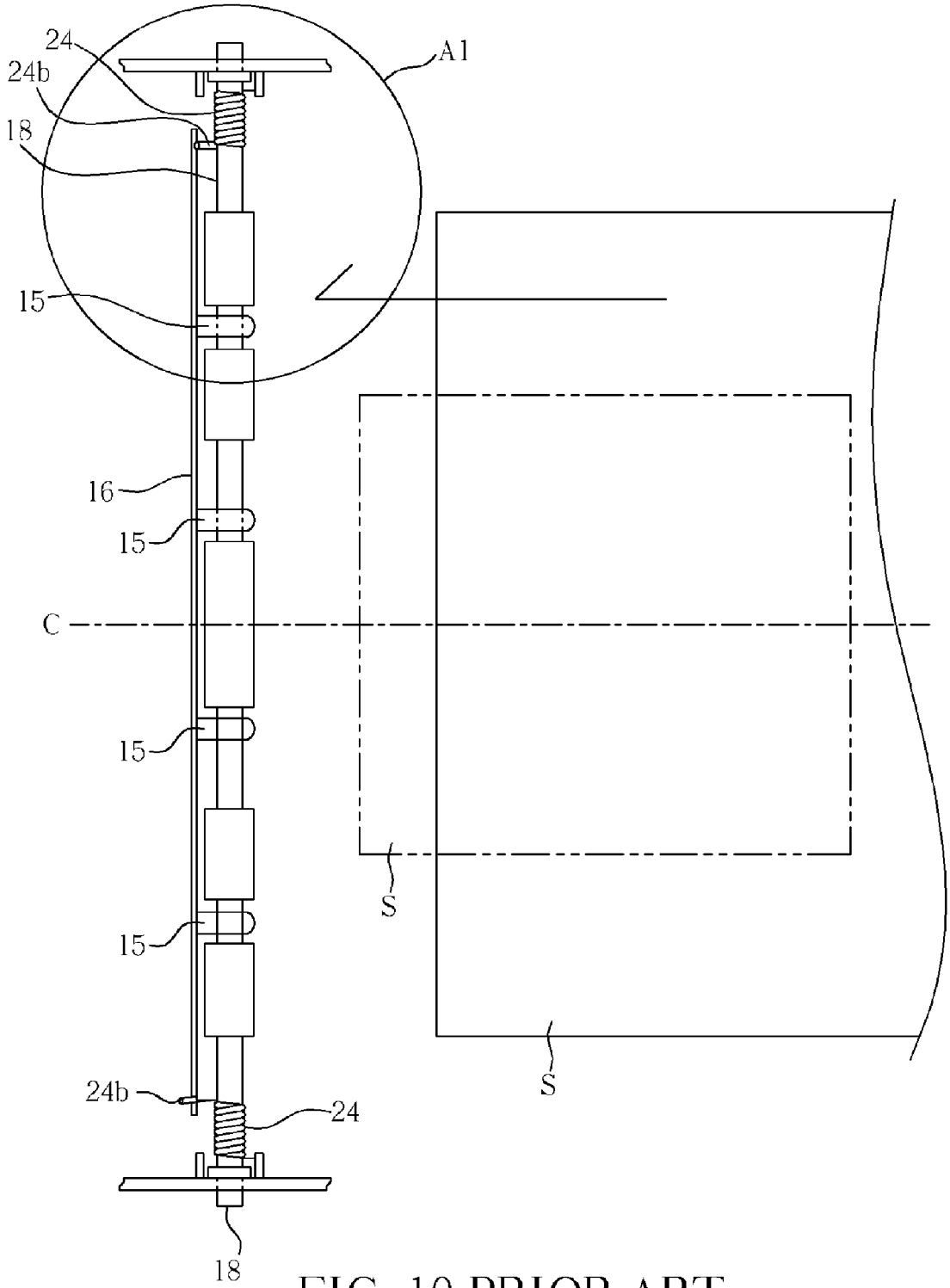
FIG. 10 PRIOR ART
FIG. 10 is a cross-sectional diagram of a de-skew device according to prior art.
Figure 11:
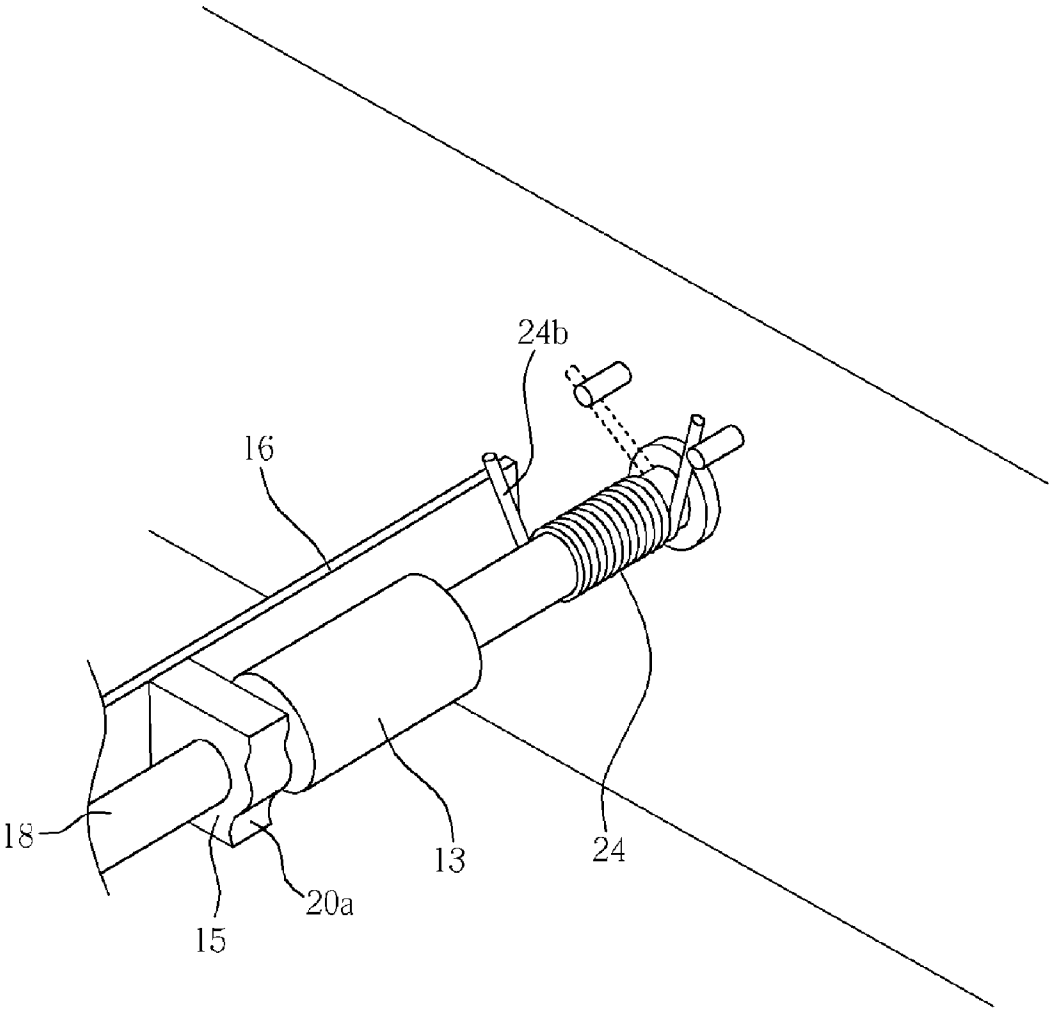
FIG. 11 PRIOR ART
FIG. 11 is an enlarged 3-D diagram of A1 portion shown in FIG. 10.

Please refer to FIG. 8, 9. A difference between a second embodiment of the present invention and the first embodiment is only in the structure of the correcting member 283. The correcting member 283 has three bearing portions 100, 101, 102, and three correcting portions 110, 111, 112 corresponding to the three bearing portions. When performing a correcting process for skew of a medium M, the suppressing end 267 of the torque spring 253 leans against the bearing portion 100, and a side of the correcting portion 110 corresponding to the bearing portion 100 is in the medium-conveying path 243. After correcting the skew of the medium M, the suppressing end 267 of the torque spring 253 leans against the bearing portion 101, and a free end of the correcting portion 111 corresponding to the bearing portion 101 is in the medium-conveying path 243 to correct skew of the next medium M.

Please note that the de-skew mechanism of the present invention can not only be applied to a scanner paper-feeding mechanism, but also to printers, auto paper-feeding machines, and copiers. The de-skew mechanism of the present invention can be applied to single-side paper-feeding mechanisms and double-side paper-feeding mechanisms. The medium above can be paper or similar objects. The bearing portion 256 in this embodiment is a protruding object contacting the suppressing end 267 of the torque spring 253. Of course, the bearing portion 256 also can be a recessed fillister, and the suppressing end 267 of the torque spring 253 can insert into the recessed fillister to suppress the turning of the correcting member 251. A common force of the feeding force of the medium and the torque force of the driving roller 246 to the correcting member 251 via the spring 252 can overcome the suppressing force on the correcting member 251. Thus, the recess fillister has the same effect as the protruding object does.

Of course, the torque spring also can be an elastic sheet having an end fixed on the frame and another end matching with the bearing portion on the correcting member. The torque spring also can be other elastic objects. In addition, the above number of the protruding objects can be adjusted according to different requirements. For example, the present invention can implement two pairs or four pairs of the correcting portions and the corresponding bearing portions. In any case, similar modifications and alterations of the mechanism above should fall into the disclosed scope of the present invention.

Those skilled in the art will readily observe that numerous modifications and alterations of the device and method may be made while retaining the teachings of the invention.

What is claimed is:

1. A de-skew mechanism, comprising:

a rotary shaft, rotated by a motor;

a driving roller, disposed on the rotary shaft and rotating with the rotary shaft;

a pinch roller, rotating in an opposite direction to the driving roller to form a nip portion to convey a medium;

a correcting member, disposed on the rotary shaft along a conveying direction of the medium, for rotating at a disposed position of the correcting member between a correcting position and a releasing position of the correcting member;

a suppressing member, selectively contacting with the correcting member, for exerting a suppressing force on the turning of the correcting member with the driving roller to allow the correcting member to be in the correcting position; and a driving member, disposed on the rotary shaft and connected to the correcting member and the driving roller, for letting the correcting member turn with the driving roller, and for allowing the correcting member to come off the suppressing member with the medium conveying force to unload the suppressing force to move the correcting member to the releasing position from the correcting position;

wherein the correcting member has a bearing portion, the bearing portion and the suppressing member selectively connect to each other to load the suppressing force; the correcting member further has a correcting portion for correcting skew of the medium, and the bearing portion and the correcting portion are positioned on two sides of the correcting member, respectively.

2. The de-skew mechanism of claim 1, wherein the suppressing member has a suppressing end, the suppressing end and the suppressing member selectively connect to each other to load the suppressing force, and the suppressing member further has a fixed end connected to an adjusting structure.

3. The de-skew mechanism of claim 2, wherein the adjusting structure includes at least two adjacent protruding pillars.

4. The de-skew mechanism of claim 1, wherein the correcting portion is a protruding object.

5. The de-skew mechanism of claim 1, wherein the bearing portion is a protruding object.

6. The de-skew mechanism of claim 1, wherein the bearing portion is a recess fillister.

7. The de-skew mechanism of claim 1, wherein the suppressing portion is an elastic object.

8. The de-skew mechanism of claim 7, wherein the elastic object is a torque spring.

9. The de-skew mechanism of claim 7, wherein the elastic object is an elastic sheet.

10. The de-skew mechanism of claim 1, wherein the driving member is a spring.

11. The de-skew mechanism of claim 1, wherein a contacting surface between the correcting portion and the medium.

* * * * *